US010787864B1

(12) United States Patent
Robertson et al.

(10) Patent No.: US 10,787,864 B1
(45) Date of Patent: Sep. 29, 2020

(54) WEB PROTECTORS FOR USE IN A DOWNHOLE TOOL

(71) Applicant: Robertson Intellectual Properties, LLC, Arlington, TX (US)

(72) Inventors: Michael C. Robertson, Arlington, TX (US); Antony F. Grattan, Arlington, TX (US); Douglas J. Streibich, Arlington, TX (US); Amy C. Stephens, Arlington, TX (US)

(73) Assignee: Robertson Intellectual Properties, LLC, Mansfield, TX (US)

( * ) Notice: Subject to any disclaimer, the term of this patent is extended or adjusted under 35 U.S.C. 154(b) by 0 days.

(21) Appl. No.: 16/400,596

(22) Filed: May 1, 2019

(51) Int. Cl.

| | |
|---|---|
| ***E21B 17/10*** | (2006.01) |
| ***E21B 17/00*** | (2006.01) |
| ***E21B 29/00*** | (2006.01) |
| ***E21B 29/02*** | (2006.01) |
| *E21B 47/017* | (2012.01) |
| *E21B 43/26* | (2006.01) |

(52) U.S. Cl.
CPC ..... *E21B 17/10* (2013.01); *E21B 17/003* (2013.01); *E21B 17/1085* (2013.01); *E21B 29/00* (2013.01); *E21B 29/02* (2013.01); *E21B 17/1007* (2013.01); *E21B 43/26* (2013.01); *E21B 47/017* (2020.05)

(58) Field of Classification Search
CPC ..... E21B 17/10; E21B 17/1007; E21B 29/00; E21B 29/02; E21B 43/26; E21B 43/243; E21B 43/247
See application file for complete search history.

(56) References Cited

U.S. PATENT DOCUMENTS

| | | | | |
|---|---|---|---|---|
| 4,889,187 | A * | 12/1989 | Terrell | E21B 29/02 166/298 |
| 2016/0186513 | A1* | 6/2016 | Robertson | E21B 23/065 |
| 2017/0298711 | A1* | 10/2017 | Aitken | E21B 43/04 |
| 2017/0335646 | A1* | 11/2017 | Huang | E21B 43/114 |
| 2019/0186243 | A1* | 6/2019 | Huang | E21B 43/1185 |

* cited by examiner

*Primary Examiner* — Tara Schimpf
(74) *Attorney, Agent, or Firm* — Matthews, Lawson, McCutcheon & Joseph, PLLC

(57) ABSTRACT

Apparatus, systems and methods provide protection for components of a downhole tool by using a liner and/or web protector to minimize, block, or prevent erosion of a pillar component, which is adjacent to an opening of the downhole tool, during activation and operation of the downhole tool. The downhole tool comprises a body having an external surface and internal volume configured to store thermite fuel, wherein the thermite fuel is configured to ignite into a molten thermite fuel. The downhole tool comprises an opening extending from the internal volume through the external surface, and a pillar defining one side of the opening, wherein the opening is configured to project the molten thermite fuel. The downhole tool includes web protectors, abutting at least an internal side of the pillar, to block the molten thermite fuel from impinging the internal side of the pillar, thus protecting the components of the downhole tool.

22 Claims, 4 Drawing Sheets

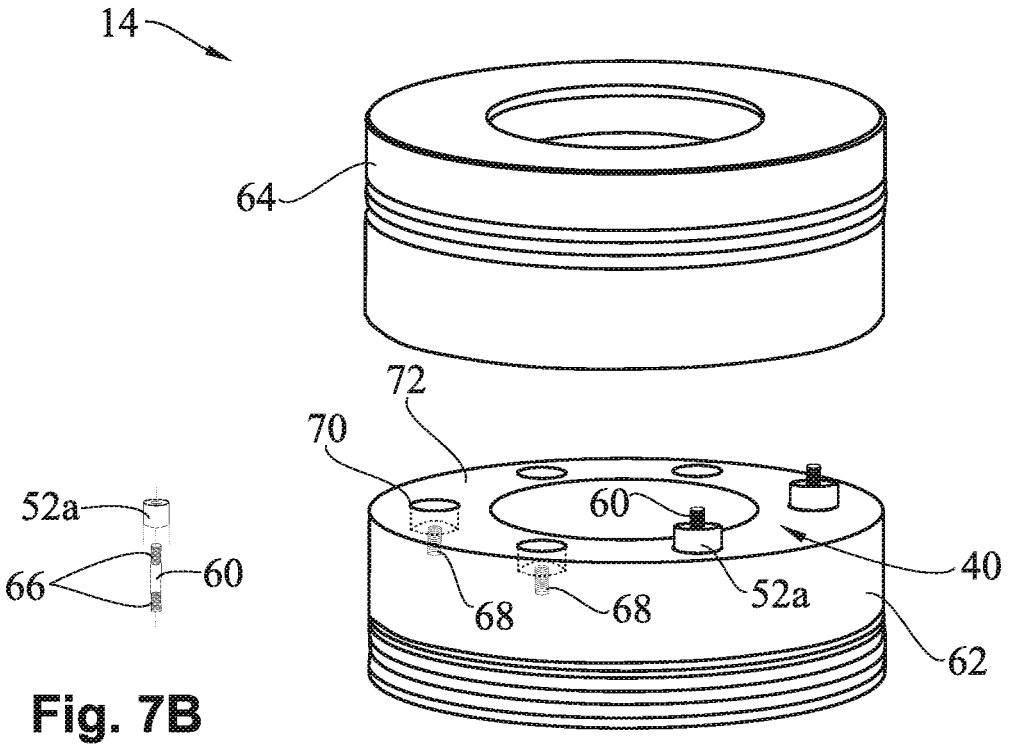
Fig. 7B
Fig. 7A
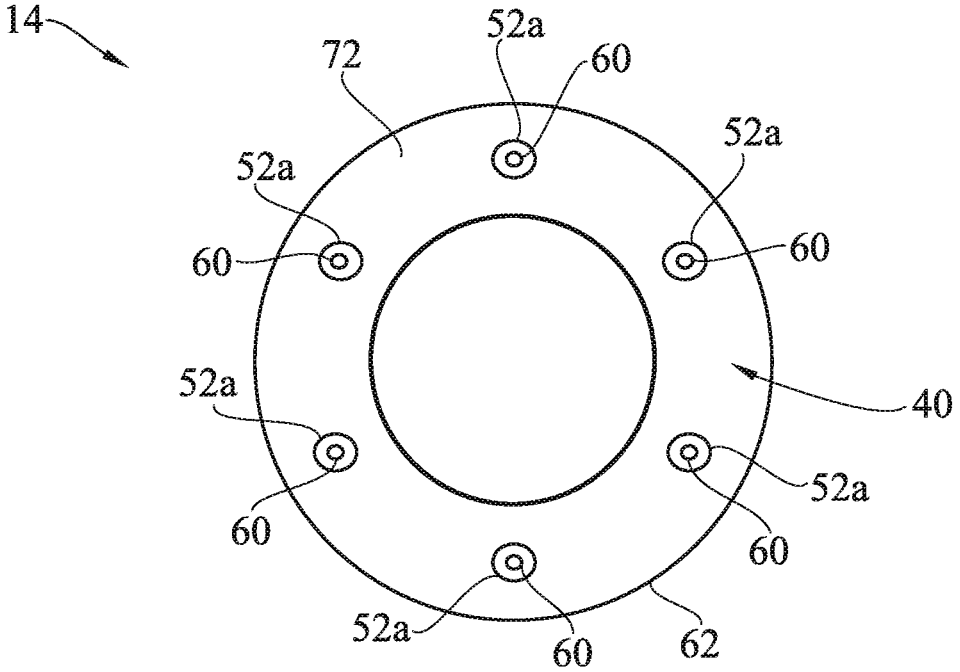
Fig. 8

WEB PROTECTORS FOR USE IN A DOWNHOLE TOOL

FIELD

Embodiments usable within the scope of the present disclosure relate, generally, to apparatus, systems, and methods for protecting one or more components of a downhole tool during activation of the downhole tool. And more particularly, the embodiments relate to systems and methods for using a liner or a web protector to minimize, block, or prevent erosion of a pillar that is adjacent to an opening of the downhole tool.

BACKGROUND

Many wellbore operations necessitate deploying a downhole tool within a wellbore. Some operations may be accomplished through the use of tools employing brute-force methods such as explosive charges, drill bits, fluid pressurized at the surface of the wellbore, or other high-energy and high-impact methods. Other less-destructive operations may require downhole tools capable of performing precise or delicate jobs. For an increasing number of these operations, a non-explosive downhole tool is preferred. Non-explosive downhole tools include, for example, torches, perforators, setting tools, fracturing equipment, and the like (collectively referred to herein as downhole tools) that can be powered through the use of thermite fuel or fuel derived from a chemical reaction.

A need exists, in the oil and gas industry, for the ability to activate non-explosive downhole tools with a controlled expulsion of the molten fuel or chemical fuel, and to maintain accuracy of the sprayed (i.e., projected) molten fuel over multiple uses of the downhole tool. Non-explosive tools are powered by a reaction that is slower and more controlled than explosive-type downhole tools. This can allow for directed blasts of molten fuel forced through nozzles or openings. Over repeated uses, the openings can be worn out and can change shape, causing inaccurate flow during firing. In some embodiments, when the downhole tool wears out, the structural integrity of the downhole tool can be compromised. In such embodiments, the downhole tool may break apart during firing, causing more trouble and potentially additional time taking the remains of the downhole tool out of the wellbore.

Additionally or alternatively, a need exists to create a forceful blast or projection of the molten fuel or chemical fuel. Past examples of downhole tools utilizing thermite fuel or chemical fuel have been limited in the size and shape of the nozzles that may be used. The previous tools have used broader nozzles due to the lack of protection to the areas around the nozzles. The nozzles wear out causing a change in the flow of the molten fuel or chemical fuel, and in some instances could cause breakage or premature destruction of the downhole tool.

The present embodiments meet these needs.

SUMMARY

The disclosed embodiments include a downhole tool that is configured to be inserted into a wellbore, wherein the downhole tool comprises: a tool body comprising an external surface and an internal volume that can be configured to store a thermite fuel, wherein the thermite fuel is configured to ignite into a molten thermite fuel. The thermite fuel comprises a metal and an oxidizer that can oxidize the metal.

The downhole tool further comprises an opening extending from the internal volume and through the external surface, wherein the opening can be configured to project (i.e., spray) the molten thermite fuel, and a pillar defining one side of the opening. The pillar can comprise an internal side that faces the internal volume, and an opening side that faces the opening. The downhole tool includes a web protector that can abut at least the internal side of the pillar to block the molten thermite fuel from impinging the internal side of the pillar.

In an embodiment, the web protector further abuts the opening side of the pillar to also block the molten thermite fuel from impinging the opening side of the pillar.

In an embodiment the downhole tool can comprise an additional opening, wherein the pillar further defines a side of the additional opening. The opening and the additional opening can be configured to project (i.e., spray) the molten thermite fuel in a pattern that severs a production tubing. In an embodiment, the opening and the additional opening together can extend around eighty percent (80%) to ninety-nine percent (99%) of a circumference of the downhole tool.

Embodiments of the downhole tool include a web protector that comprises polyether ether ketone, another polymer, a ceramic material, a graphite material, or combinations thereof. In an embodiment, the web protector can be attached to the pillar with a securing connector, wherein the securing connector can comprise a chemical adhesive, a magnet, a mechanical fastener, or combinations thereof.

In an embodiment, the downhole tool can comprise a liner that can be configured to line the internal volume. The liner can comprise a first material, and the web protector can comprise a second material that is different from the first material. In an embodiment, the web protector is the liner.

An embodiment of the downhole tool can include: an opening for projecting (i.e., spraying) molten thermite fuel, a pillar that defines one side of the opening, and a web protector that comprises a body that is made from a material that is heat resistant and erosion resistant to the molten thermite fuel. The body of the web protector can further include at least one side that is configured to abut a side of the pillar of the downhole tool to block the molten thermite fuel from impinging the side of the pillar. In an embodiment, two sides of the body of the web protector can abut two sides of the pillar.

The material of the web protector can comprise polyether ether ketone, another polymer, a ceramic material, a graphite material, or combinations thereof. In an embodiment, the web protector can further include a securing connector for attaching the web protector to the pillar, wherein the securing connector can comprise a chemical adhesive, a magnet, a mechanical fastener, or combinations thereof. In an embodiment, the non-explosive fuel comprises: a thermite, a thermite mixture, or a chemical. In an embodiment, the chemical is an acid, nitrogen fluoride, a nitrogen fluoride mixture, a nitrogen trifluoride, a bromine trifluoride, or a solid gas.

Embodiments of the present invention include a method of using a downhole tool within a wellbore, wherein the downhole tool includes a thermite fuel that can comprise a metal and an oxidizer that can oxidize the metal. The thermite fuel can be contained within an internal volume of the downhole tool. The downhole tool can further comprise an opening for projecting (i.e., spraying) molten thermite fuel and a pillar defining one side of the opening. The steps of the method comprise: attaching a web protector to the pillar of the downhole tool so that at least one side of the web protector abuts a side of the pillar, wherein the web protector comprises a material that is heat resistant and erosion resistant to the molten thermite fuel, and inserting the downhole tool into the wellbore. The steps of the method continue by activating the thermite fuel in the internal volume of the downhole tool to generate the molten thermite fuel, and projecting (i.e., spraying) the molten thermite fuel through the opening of the downhole tool, wherein the web protector blocks the molten thermite fuel from impinging the side of the pillar.

The steps of the method can further comprise retrieving the downhole tool from the wellbore, replacing the thermite fuel with a second thermite fuel, inserting the downhole tool into the wellbore a second time, activating the second thermite fuel to generate a second molten thermite fuel, and projecting (i.e., spraying) the second molten thermite fuel through the opening of the downhole tool. In an embodiment, the projecting (i.e., spraying) of the molten thermite fuel can sever a production tubing within the wellbore.

In an embodiment, the web protector can be attached to the pillar with at least one of a chemical, a magnetic, and a mechanical connection.

BRIEF DESCRIPTION OF THE DRAWINGS

In the detailed description of various embodiments usable within the scope of the present disclosure, presented below, reference is made to the accompanying drawings, in which:

FIG. 6 illustrates a side view of the embodiment of the downhole tool illustrated in

FIG. 5.

FIGS. 7A and 7B illustrate a side view of an embodiment of the downhole tool having a web protector surrounding pillar connectors.

FIG. 8 illustrates a cross-sectional top view of the embodiment of the downhole tool illustrated in FIGS. 7A and 7B.

One or more embodiments are described below with reference to the listed FIGS.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "uphole", "downhole", and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figures 1, 2:
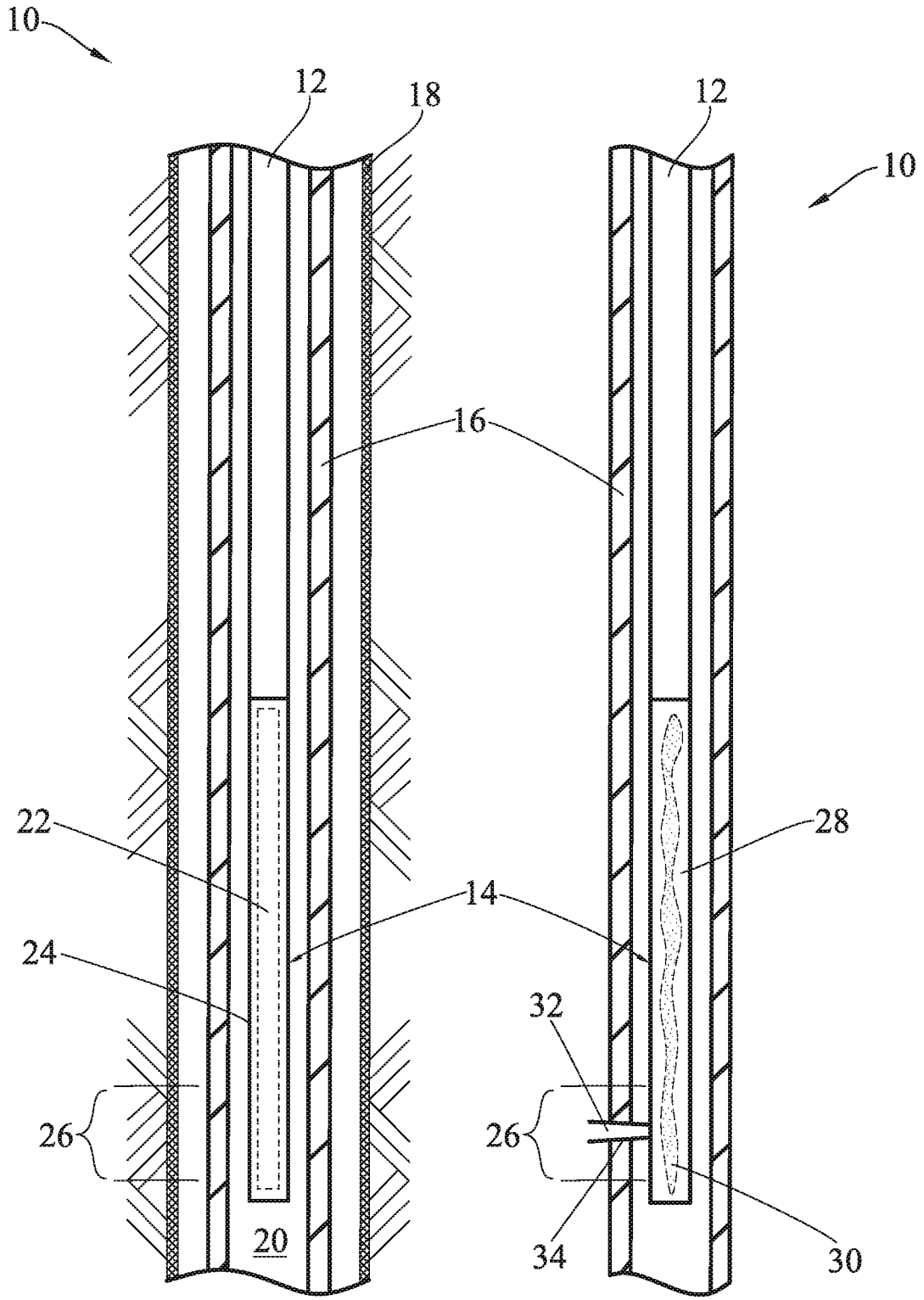
FIG. 1 illustrates a cross-sectional schematic view of an embodiment of a system located in a possible operating environment.
FIG. 2 illustrates a cross-sectional schematic view of the downhole tool of FIG. 1 firing on a target location.

FIG. 1 illustrates a cross-sectional schematic view of an embodiment of a system 10 of the present invention that is located in a possible operating environment. The system 10 may include a tubing string 12 and a downhole tool 14 that have been lowered into production tubing 16 and/or casing 18 within a wellbore 20. The casing 18 may be cemented or otherwise set within the wellbore 20 to protect the wellbore and to support the surrounding rock structure and prevent a collapse. The wellbore 20 may be located in or through a production zone from which hydrocarbons or other fluid may be pumped out through the production tubing 16. In some situations during the operation of the system 10, the production tubing 16, casing 18, or other components within the wellbore 20 may need to be cut, severed (i.e., an upper section completely detached from a lower section), or torched to facilitate removal or disposal of a part of the wellbore 20. For example, the production tubing 16 may be perforated to enable fluid to enter into the production tubing 16. In other situations, severing the production tubing 16 may facilitate the removal of all the production tubing 16 above the cut.

To complete such operations, the downhole tool 14 may hold a non-explosive fuel, such as a thermite fuel 22, during descent down the wellbore 20. As shown, an external surface 24 can protect the thermite fuel 22 as the downhole tool 14 descends to a target area 26. The target area 26 is the location where the downhole tool 14 is meant to perform the operation. The thermite fuel 22 is non-explosive fuel, but once activated, the thermite fuel can burn at a temperature that may exceed 3000 degrees Celsius. The reaction occurs over a long enough period of time that the resultant molten fuel may be directed through a nozzle without causing the external surface 24 to deform due to internal pressure.

The thermite fuel includes a combination or a mixture of a metal and an oxidizer. Examples of such metals can include: aluminum, magnesium, chromium, nickel, silver and/or other metals.

When the metal is combined or mixed with the oxidizer, a metal oxide is created that can form, or at least partially form, a combustion product(s). Oxidizers that can be used to oxidize the metal can include, for example: cupric oxide, iron oxide, aluminum oxide, ammonium perchlorate, and/or other oxidizers. Applicant incorporates U.S. Pat. No. 8,196,515, having the title of "Non-Explosive Power Source For Actuating A Subsurface Tool" by reference, in its entirety, herein. The ignition point of thermite can vary, depending on the specific composition of the thermite. For example, the metal and the oxidizer may or may not be combined prior to ignition, which can affect the ignition point. As another example and in regard to thermite mixtures, the ignition point of a thermite mixture of aluminum and cupric oxide is approximately 1200 degrees Fahrenheit, while other thermite mixtures or combinations can have an ignition point as low as 900 degrees Fahrenheit.

When ignited, the thermite produces a non-explosive, exothermic reaction. The rate of the thermite reaction occurs on the order of milliseconds, while an explosive reaction has a rate occurring on the order of nanoseconds. While explosive reactions can create detrimental explosive shockwaves within a wellbore, use of a thermite-based power charge (non-explosive or deflagration reaction) avoids such shockwaves.

The thermite combination can include a polymer, which can be disposed in association with, or as a part of, the thermite combination. The polymer can be of a type that produces a gas responsive to the thermite reaction, which slows the reaction time of the thermite. Usable polymers can include, without limitation, polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polytetrafluroethylene, polyketone, polyetheretherketone, polytherlmide, polyethersulfone, polyamide imide, styrene acrylonitrile, cellulose propionate, diallyl phthalate, melamine formaldehyde, other similar polymers, or combinations thereof.

FIG. 2 illustrates a cross-sectional schematic view of the downhole tool 14 of FIG. 1 firing on the target location 26. The downhole tool 14 may activate the thermite fuel 22, which rapidly reacts to produce molten fuel 30 in an internal volume 28 of the downhole tool 14. As the thermite fuel 22 reacts to form the molten fuel 30, the molten fuel 30 heats up and expands. As discussed above, the thermite fuel 22 can include polymers or gasifying elements to increase the expansion of the molten fuel 30. The thermite fuel 22, in certain embodiments, burns from the center outward, and is naturally heat-insulating. The thermite fuel 22 can thus protect the downhole tool 14 as the thermite fuel 22 burns from the inside toward the outside. To further ensure the external surface 24 does not suffer damage during firing, the downhole tool 14 may include protective elements such as a liner along the internal volume 28.

As the molten fuel 30 continues to expand, the downhole tool 14 projects a molten fuel projection (i.e., spray) 32 at the target area 26. The molten fuel projection 32 may be shaped by an opening in the downhole tool 14 as described below. A sufficiently focused molten fuel projection 32 may contact the target area 26 with enough force to destroy some or all of the target area 26. Thus, a hole 34 may be cut or torched through the target area 26 or the production tubing 16, casing 18, or further into the formation. Additionally, the hole may include a complete circle of the production tubing 16, severing the bottom of the production tubing 16 from the top and allowing retrieval of the top production tubing 16.

Figure 3:
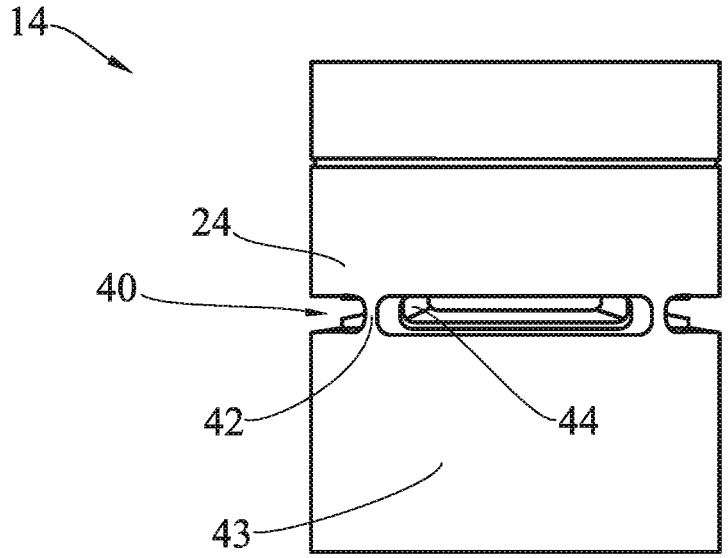
FIG. 3 illustrates a side view of an embodiment of the downhole tool having a liner.

FIG. 3 illustrates a perspective view of an embodiment of the downhole tool 14 that may be used within the system 10 of FIGS. 1 and 2. As illustrated, the downhole tool 14 may include openings 40. The openings 40 can allow the molten fuel 30 to flow from the internal volume 28 of the downhole tool 14 to the target area 26 where the molten fuel projection 32 can destroy the target 34. In certain embodiments, the openings 40 are shaped to achieve a specific flow of the molten fuel projection 32. For example, a round, wide opening 40 would produce a slow molten fuel projection 32 that applies more molten fuel 30 to the inside of the production tubing 16 or the casing 18. On the other hand, a flat, narrow opening 40 would produce a more focused molten fuel projection 32 that cuts or penetrates through the production tubing 16 or the casing 18.

In certain embodiments, the system 10 may be used to completely sever the production tubing 16, or other downhole component. In these embodiments, the openings 40 produce molten fuel projection 32 around a significant portion of the circumference of the downhole tool 14. A significant portion of the circumference means that the molten fuel projection 32 produces a hole 34 in the production tubing 16 such that the target area 26 will be severed substantially completely or completely by pulling on the production tubing 16 from the surface. For such an operation of severing, the downhole tool 14 may include several openings 40 that cover a significant portion of the circumference of the downhole tool 14. For example, the openings 40 may cover eighty to ninety-nine percent (80%-99%) of the circumference, eighty-five to ninety-five percent (85%-95%) of the circumference, about ninety percent (90%) of the circumference, or some other percentage of the circumference. In the illustrated embodiment, the downhole tool 14 includes four openings 40.

Between the openings 40, a web protector and/or a pillar 42 can hold the downhole tool 14 together, and can define the shape of the openings 40 by bordering the opening 40 on one side. Additional pillars 42 may border the openings 40 on other sides. As the molten fuel projection 32 projects (i.e., sprays) through the openings 40, it can weaken the pillars 42 due to heat or contact erosion. For example, heating up pillars 42 made from certain types of steel can make the pillars 42 elastic, and the weight of the downhole tool 14 (i.e., a lower portion 43) can stretch the pillars 42. This can affect the flow of the molten fuel projection 32 by changing the shape of the openings 40. Additionally, the pillars 42 may, sometimes, be stretched beyond the pillar's 42 ability to hold the downhole tool 14, causing the downhole tool 14 to split (i.e., at the openings 40). That is, if the pillars 42 are compromised, the lower portion 43 of the downhole tool 14 can break apart from the remainder of the downhole tool 14. This can cause problems of many types for operation of the system 10. The lower portion 43 may fall and get stuck within the wellbore 20, requiring an additional operation for retrieval. Additionally, the breaking of the lower portion 43 may severely hinder the operation of the downhole tool 14 in cutting, destroying, or annihilating the target area 26. Specifically, if the lower portion 43 splits from the downhole tool 14, the molten fuel 30 possibly could be poured down the wellbore 20 without contacting, or with minimal contact of, the target area 26.

As mentioned above, the downhole tool 14 may include a liner 44 that protects the inside of the downhole tool 14 from the molten fuel 30. To ensure that the pillars 42 also remain structurally intact and do not break, the liner 44 may also protect the pillar 42 from the molten fuel 30, and the liner may have openings that coincide with the openings 40 in the downhole tool 14. The liner 44 may be constructed from a material that is temperature resistant, and does not react with the thermite fuel 22 or molten fuel 30. For example, the liner 44 may be constructed from carbon-based materials such as graphite or carbon-fiber. The liner 44 may also include polyetheretherketone (PEEK) a semi-crystalline organic polymer thermoplastic, exhibiting a highly stable chemical structure. The liner 44 may also include other members of the polyaryletherketone (PAEK) polymer group, or other polymers.

Figure 4:
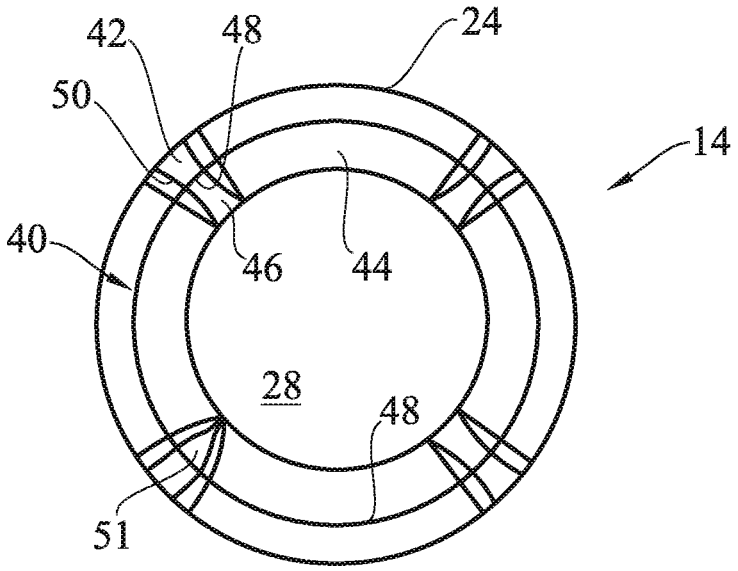
FIG. 4 illustrates a cross-sectional top view of the embodiment of the downhole tool illustrated in FIG. 3.

FIG. 4 illustrates a cross-sectional top view of the embodiment of the downhole tool 14 of FIG. 3. The view shows the internal volume 28 and the external surface 24 of the downhole tool 14, as well as the openings 40 where the molten fuel 30 flows from the internal volume 28 past the external surface 24. The liner 44, as illustrated, blocks the molten fuel 30 from impinging on an internal volume face 48 of the downhole tool 14. The liner 44 also includes liner pillars 46 that block the molten fuel 30 from impinging on the pillars 42. Without the liner pillars 46, the molten fuel 30 would be forced against the internal volume face 48 of the pillar 42 during firing.

Eventually, the molten fuel 30 and the molten fuel projection 32 flowing past the pillar 42 could erode the internal volume face 48, and the pillar 42 could fail. The liner pillar 46 can be shaped to direct the molten fuel 30 and the molten fuel projection 32 away from an opening side 50 of the pillar 42. That is, the liner 44 and the liner pillar 46 may be shaped and/or configured to direct the molten fuel 30 away from all internal sides (i.e., internal volume face 48 and opening side(s) 50). For example, the liner pillar 46 may be wider than the pillar 42, or may have a flare 51, such that the liner pillar 46 broadens in width further from the internal volume 28. This broadening can focus the flow of the molten fuel projection 32 away from the opening side 50 of the pillar 42.

Figure 5:
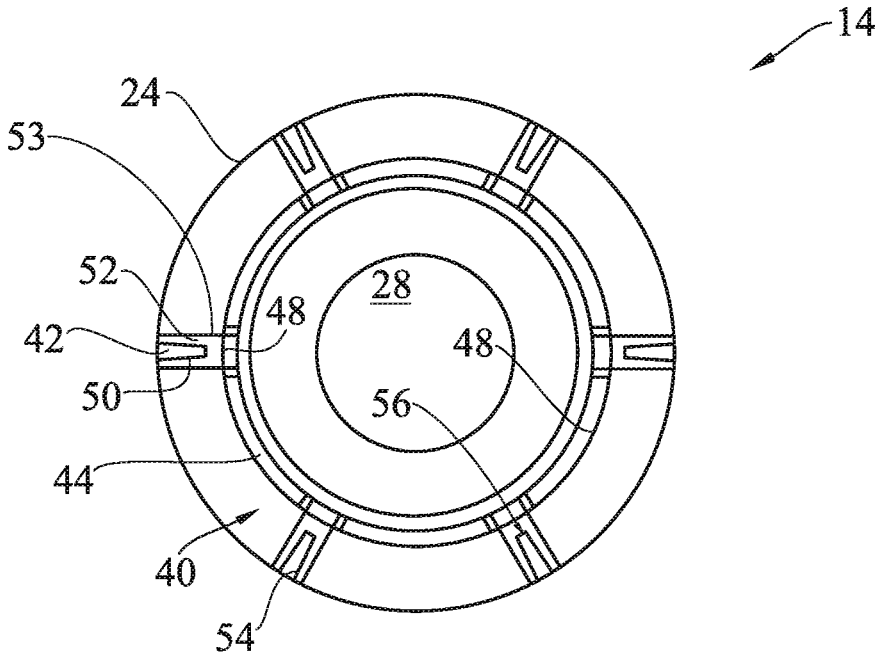
FIG. 5 illustrates a cross-sectional top view of an embodiment of the downhole tool having a web protector.

FIG. 5 illustrates a cross-sectional top view of an embodiment of a downhole tool 14 that employs web protectors 52 for protection of the pillar(s) 42. In addition to temperature/heat damage, and erosion just on the internal volume face 48, the pillars 42 may be eroded from the side due to the molten fuel projection 32. As the molten fuel projection 32 sprays (i.e., projects) through the openings 40, the flow may not be laminar. Turbulent eddies of molten fuel projection 32 may curl into the opening sides 50, causing erosion of the pillars 42. Therefore, to protect the opening sides 50 and the internal volume face 48 of the pillar(s) 42, certain embodiments of the downhole tool 14 may employ web protectors 52 to protect the internal volume face 48 and the opening side(s) 50 of the pillar(s) 42.

The web protectors 52 may be constructed of the same material as the liner 44, or may include different materials. For example, the liner 44 that is lining the internal volume face 48 of the internal volume 28 may include graphite, while the web protector 52 can be made from PEEK material. These types of materials are better suited to resist the heat and erosion of the molten fuel 30 as it passes through the opening 40. Embodiments tested with web protectors 52 have shown that the pillars 42 suffer much less stretching and weakening, and can therefore be constructed with smaller pillars 42 without breaking. As explained above, having a smaller pillar 42, and correspondingly larger opening 40 can provide a more thorough cutting of the target area 26, and thus more efficient and effective use of the downhole tool 14.

The web protector 52 may be customized and manufactured to be installed in specific downhole tools 14. For example, the web protector 52 may include a body 53 and a contacting side 54 that is shaped to completely contact the pillar 42 on all of the internal sides (e.g., internal volume face 48, and two opening sides 50). The web protectors 52 may be manufactured separately from any liner 44 within the internal volume 28. The liner 44 may thus be advantageously manufactured as a simple cylinder matching the dimensions of the internal volume 28. Separate manufacture of the liner 44 and the web protectors 52 may further enable the web protectors 52 to be replaced individually, based on need, and replaced more often or less often than the liner 44.

The web protectors 52 may be held in place around the pillar(s) 42 with a securing connector 56. The securing connector 56 may include a chemical, magnetic, or mechanical connection that keeps the web protector 52 from moving during descent of the downhole tool 14, and firing. For example, the connector 56 may include an epoxy that semi-permanently secures the web protector 52 in place. Additionally or alternatively, the connector 56 may include a magnet within the web protector 52 that enables an operator to remove the web protector 52 by hand, without requiring a tool. In certain embodiments, the connector 56 may include a snapping feature that locks or pinches into a corresponding feature on the pillar 42. Additionally or alternatively, the web protectors 52 may be held in place by inserting the liner 44 after the web protectors 52 have been placed around the pillars 42. The liner 44 can push the web protectors 52 tightly against the pillars 42 so that the web protectors 52 do not shift or dislodge.

Figure 6:
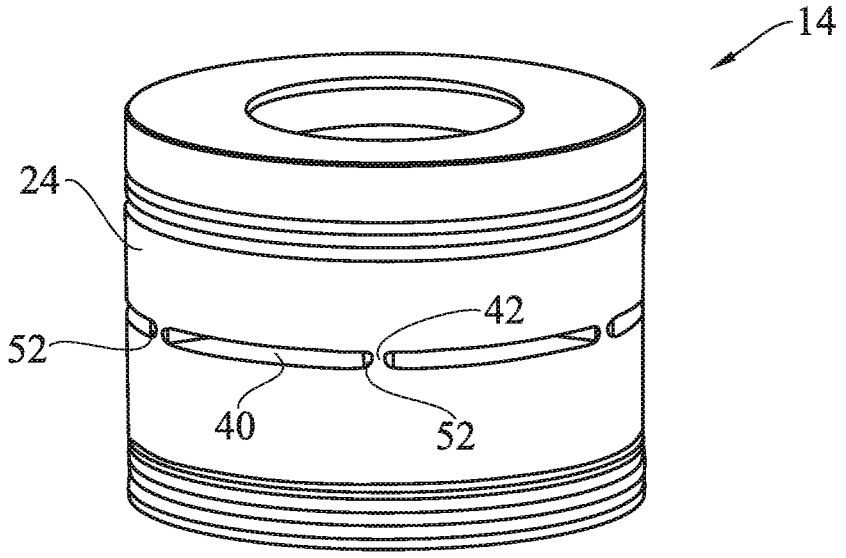

FIG. 6 illustrates a perspective view of the embodiment of the downhole tool 14 illustrated in FIG. 5. As illustrated, the downhole tool 14 includes the web protectors 52 surrounding the pillar(s) 42. With the web protectors 52 protecting the pillars 42, the openings 40 may be narrower or wider without risking damage to the pillars 42. This enables the molten fuel projection 32 to exit through the opening 40 with more force. A more forceful molten fuel projection 32 penetrates further, which saves time, for example, by using fewer tool runs to complete an operation, and/or using less thermite fuel 22/molten fuel 30 to complete the required operation.

FIGS. 7A and 7B illustrate a side view of an embodiment of the downhole tool 14 having a web protector 52*a* surrounding pillar connectors 60. The illustrated embodiment of the downhole tool 14 includes separate pieces for a bottom 62 and a top 64 of the downhole tool 14. The pillar connectors 60 connect the bottom 62 to the top 64 by threading pillar threads 66 (see FIG. 7B) into threaded holes 68. The threaded holes 68 may be located in the bottom 62 and the top 64, and may be oppositely threaded such that rotating the pillar connector 60 in a single direction simultaneously screws the pillar threads 66 into the bottom 62 and the top 64. The pillar connectors 60 may be protected over the entire surface by a cylindrical web protector 52*a* that can be slid around the outside of the pillar connector 60 before it is threaded in place. The web protector 52*a* may further enhance the protection of the pillar connector 60 by being counter sinked within a counter-sink hole 70 in a surface 72 of the opening 40. Though not illustrated, the top 64 may also include the countersink holes 70 and the threaded holes 68. FIG. 8 illustrates a cross-sectional top view of the bottom 62 of the downhole tool 14 shown in FIGS. 7A and 7B. FIG. 8 shows the web protector 52*a* surrounding pillar connectors 60 on the surface 72 of the opening 40.

The downhole tool 14 discussed above may be a tool that contains thermite fuel 22. In other embodiments, the downhole tool 14 may include other non-explosive fuels, such as chemicals that are activated by mixing the chemicals to form a resultant chemical fuel. The resultant chemical fuel may be directed through the nozzle without causing the external surface 24 to deform due to internal pressure. The liner 44 and the web protectors 52 may protect the inside of the downhole tool 14 and the pillars 42 from the chemical fuel in the same manner as discussed above. Some examples of the chemical used to form the resultant chemical fuel include: acids, nitrogen fluoride and mixtures (e.g., nitrogen fluoride and molecular fluoride), nitrogen trifluoride, bromine trifluoride, or solid gases (e.g., nitrogen).

While various embodiments usable within the scope of the present disclosure have been described with emphasis, it should be understood that within the scope of the appended claims, the present invention can be practiced other than as specifically described herein.

What is claimed is:

1. A downhole tool configured to be inserted into a wellbore, comprising:

a tool body comprising an external surface and an internal volume configured to store a thermite fuel, wherein the thermite fuel is configured to ignite into a molten thermite fuel;

an opening extending from the internal volume and through the external surface, wherein the opening is configured to project the molten thermite fuel;

a pillar defining one side of the opening and comprising an internal side facing the internal volume, and an opening side facing the opening; and a web protector abutting at least the internal side of the pillar to block the molten thermite fuel from impinging the internal side of the pillar, wherein the web protector comprises a flare to focus the molten thermite fuel away from the opening side of the pillar.

2. The downhole tool of claim 1, wherein the web protector further abuts the opening side of the pillar to block the molten thermite fuel from impinging the opening side of the pillar.

3. The downhole tool of claim 1, comprising an additional opening, wherein the pillar further defines a side of the additional opening.

4. The downhole tool of claim 3, wherein the opening and the additional opening are configured to project the molten thermite fuel in a pattern that severs a production tubing.

5. The system of claim 4, wherein the opening and the additional opening together extend around 80 percent to 99 percent of a circumference of the downhole tool.

6. The downhole tool of claim 1, wherein the web protector comprises polyetheretherketone, another polymer, a ceramic material, a graphite material, or combinations thereof.

7. The downhole tool of claim 1, wherein the web protector is attached to the pillar with a securing connector.

8. The downhole tool of claim 7, wherein the securing connector comprises a chemical adhesive, a magnet, a mechanical fastener, or combinations thereof.

9. The downhole tool of claim 1, further comprising a liner configured to line the internal volume.

10. The downhole tool of claim 9, wherein the liner comprises a first material, and the web protector comprises a second material that is different from the first material.

11. The downhole tool of claim 1, wherein the web protector is a liner.

12. A web protector for use on a downhole tool comprising an opening for projecting a non-explosive fuel and a pillar defining one side of the opening, wherein the web protector comprises:

a body comprising a material that is heat resistant and erosion resistant to the non-explosive fuel, wherein the body further comprises at least one side that is configured to abut a side of the pillar of the downhole tool to block the non-explosive fuel from impinging the side of the pillar, and wherein the body is configured to be detachably attached to the pillar.

13. The web protector of claim 12, wherein two sides of the body abut two sides of the pillar.

14. The web protector of claim 12, wherein the material of the web protector comprises polyetheretherketone, another polymer, a ceramic material, a graphite material, or combinations thereof.

15. The web protector of claim 12, further comprising a securing connector for attaching the web protector to the pillar.

16. The web protector of claim 15, wherein the securing connector comprises a chemical adhesive, a magnet, a mechanical fastener, or combinations thereof.

17. The web protector of claim 12, wherein the non-explosive fuel comprises: a thermite, a thermite mixture, or a chemical.

18. The web protector of claim 17, wherein the chemical is an acid, nitrogen fluoride, a nitrogen fluoride mixture, a nitrogen trifluoride, a bromine trifluoride, or a solid gas.

19. A method of using a downhole tool within a wellbore, wherein the downhole tool comprises a thermite fuel contained within an internal volume of the downhole tool, an opening for projecting molten thermite fuel, and a pillar defining one side of the opening, and wherein the method comprises:

attaching a web protector to the pillar of the downhole tool so that at least one side of the web protector abuts a side of the pillar, wherein the web protector comprises a material that is heat resistant and erosion resistant to the molten thermite fuel, and comprises a flare to focus the molten thermite fuel away from a side surface of the opening;

inserting the downhole tool into the wellbore;

activating the thermite fuel in the internal volume of the downhole tool to generate the molten thermite fuel; and projecting the molten thermite fuel through the opening of the downhole tool, wherein the web protector blocks the molten thermite fuel from impinging the side of the pillar.

20. The method of claim 19, further comprising:

retrieving the downhole tool from the wellbore;

replacing the thermite fuel with a second thermite fuel;

inserting the downhole tool into the wellbore a second time;

activating the second thermite fuel to generate a second molten thermite fuel; and projecting the second molten thermite fuel through the opening of the downhole tool.

21. The method of claim 19, wherein projecting the molten thermite fuel severs a production tubing within the wellbore.

22. The method of claim 19, wherein the web protector is attached to the pillar with at least one of a chemical, a magnetic, and a mechanical connection.

* * * * *